US005662413A

United States Patent [19]

Akiyama

[11] Patent Number: 5,662,413

[45] Date of Patent: Sep. 2, 1997

[54] TRIM FOR RECESSED LIGHTING FIXTURE

[75] Inventor: Steven Randall Akiyama, Park Forest, Ill.

[73] Assignee: Cooper Industries, Inc., Houston, Tex.

[21] Appl. No.: 646,102

[22] Filed: May 7, 1996

[51] Int. Cl.[6] ..... F21S 1/06

[52] U.S. Cl. ..... 362/365; 362/147; 362/148

[58] Field of Search ..... 362/364, 365, 362/366, 147, 148

[56] References Cited

U.S. PATENT DOCUMENTS 3,099,404 7/1963 Kaufman et al. ..... 362/366

*Primary Examiner*—Carroll B. Dority

*Attorney, Agent, or Firm*—Burns, Doane, Swecker & Mathis LLP

[57] ABSTRACT

A trim for a recessed light fixture includes a body open at its bottom end and having a top wall at its upper end. Formed in the top wall is a circular aperture and a pair of diametrically opposed slots spaced radially from the aperture. A lamp socket is mounted in the aperture such that a cylindrical lower portion of the socket extends through the aperture, and spring latches of the socket pass through respective ones of the slots. A gasket is interposed between the socket and top wall and is compressed within the aperture to create an air seal.

8 Claims, 3 Drawing Sheets

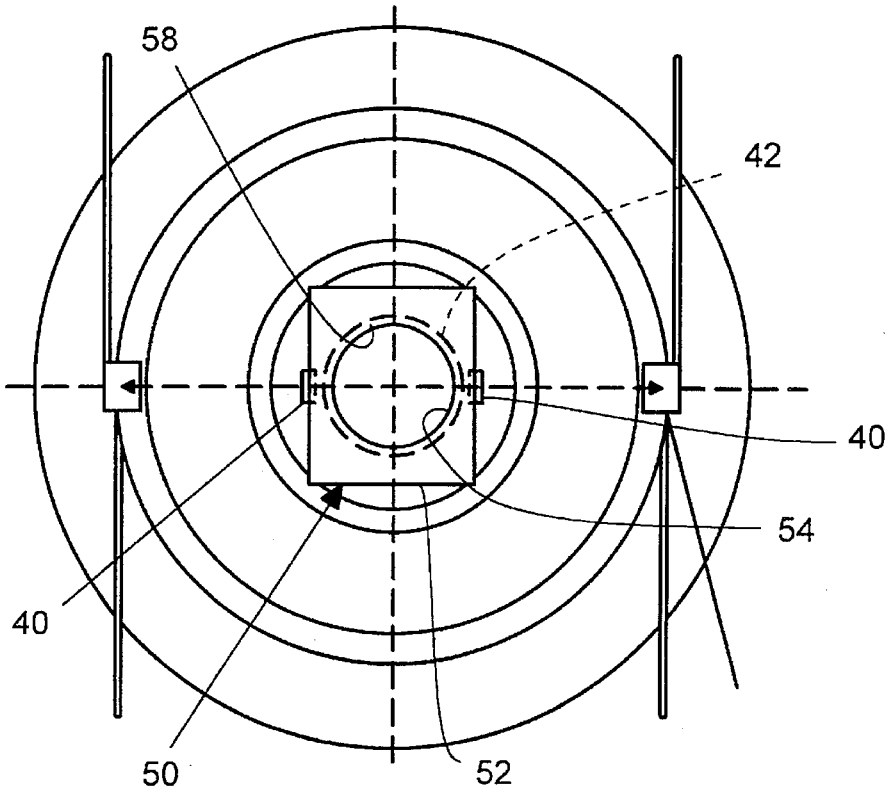
FIG. 3
FIG. 4
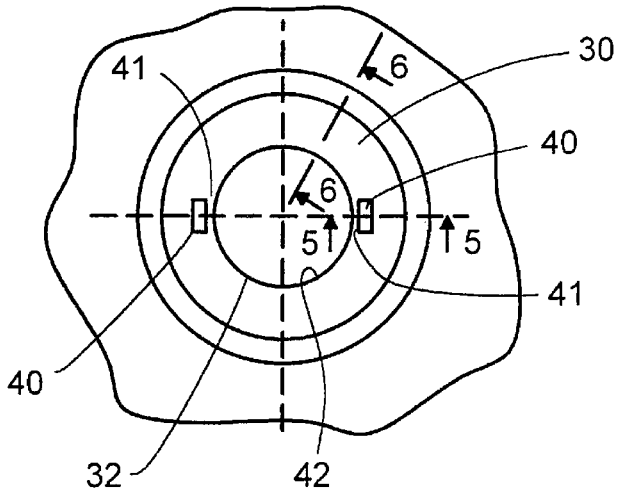

TRIM FOR RECESSED LIGHTING FIXTURE

BACKGROUND OF THE INVENTION

The present invention relates to recessed light fixtures and, in particular, to a trim for such fixtures.

Recessed light fixtures typically include a housing affixed to a ceiling structure, a trim mounted to the housing, and a lamp socket attached to the housing or trim.

A standard trim includes a laterally outwardly projecting trim ring at its lower end for engaging the ceiling surface in order to cover the edge of a hole in the ceiling through which the trim extends.

Many jurisdictions require that the air (heat) exchange between the internal space (heated/air-conditioned rooms) and the outer envelope of a building be restricted in order to improve energy efficiency.

Recessed ceiling fixtures represent a potential source of air exchange, since they are mounted in a hole formed in the ceiling. The trim ring functions to resist air flow through a gap formed between the outside of the trim and the edge of the hole. In order to resist the flow of air through the center of the trim, it is conventional to install a transparent plate formed of glass or plastic across the bottom of the trim to close the center of the trim. That, however, significantly increases the cost of the trim.

One type of trim includes an upper reflector portion having a top horizontal wall on which the lamp socket is mounted by a snap-in coupling. A lamp mounted in the socket projects into the reflector portion through a center aperture formed in the top wall. However, due to air leakage which can occur between the socket and the top wall via the center aperture, it is necessary to provide a transparent plate for closing the bottom of the trim, as described above, or to provide a sealed housing in which the trim is mounted, either of which expedients is rather costly.

It has also been proposed to provide calking around the outside of the socket to provide an air seal, but the application of calk is time-consuming and messy. Also, in the event that it becomes necessary to remove an installed reflector for cleaning, the seal would be destroyed.

SUMMARY OF THE INVENTION

The present invention relates to a trim for a recessed lighting fixture. The trim comprises a trim body, a lamp socket, and a gasket. The trim body has a laterally outwardly extending trim ring at a lower open end of the trim body, and a top wall disposed at an upper end of the trim body. The top wall includes a circular aperture and a pair of slots. The lamp socket includes a lower cylindrical portion projecting through the aperture, and spring legs projecting through respective ones of the slots for releaseably locking the socket to the top wall. The gasket is formed of a pliable material and is interposed between the socket and the top wall for producing an air seal therebetween.

Preferably, the inner periphery of the gasket extends radially inwardly of an edge of the aperture and is compressed within the aperture between the edge of the aperture and the lower cylindrical portion of the socket.

The slots are preferably spaced radially outwardly of the aperture.

BRIEF DESCRIPTION OF THE DRAWINGS

The objects and advantages of the invention will become apparent from the following detailed description of a preferred embodiment thereof in connection with the accompanying drawing in which like numerals designate like elements and in which:

FIG. 3 is a top plan view of the trim depicted in FIG. 2;

FIG. 4 is a fragmentary top plan view of the trim, with a gasket removed therefrom;

DETAILED DESCRIPTION OF A PREFERRED EMBODIMENT OF THE INVENTION

Figure 1:
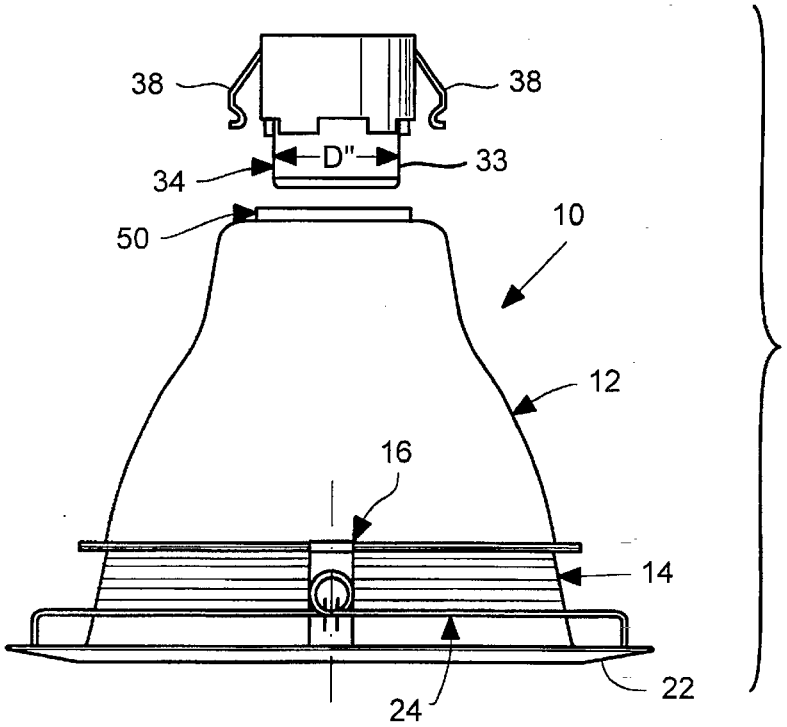
FIG. 1 is an exploded side elevational view of a trim according to the present invention, and a socket to be mounted therein.

A trim 10 is of the reflector/baffle type in that it comprises a body having an upper reflector portion 12 and a lower baffle portion 14. Those portions are formed of separate pieces that are interconnected by spring clips 16 of the type described in application Ser. No. 08/646,101, filed May 7, 1996. Alternatively, the reflector and baffle portions could be formed of a single piece. The reflector 12 reflects light downwardly, while the inside surface 18 of the baffle portion is black and has stepped surfaces 20 which avoid a downward reflection of light.

A lower end of the baffle piece 14 is bent to form a laterally outwardly extending trim ring 22 which covers the edge of a hole formed in the ceiling for receiving the trim 10.

A spring arrangement, such as a pair of torsion springs 24, is mounted on the spring clips for elastically connecting the trim to a housing (not shown) that is affixed to the ceiling structure.

The reflector portion 14 includes a top wall 30 having a central aperture 32 formed therein for receiving a cylindrical lower portion 33 of a conventional lamp socket 34. The lamp socket 34 includes a conventional metal spring latch having elastic legs 38 that are adapted to be received in respective slots 40 (see FIG. 4) formed in the top wall 30 in radially outwardly spaced relationship with the central aperture 32 to create a snap fit coupling for the socket. Thus, a thin strip of metal 41 is situated between the aperture 32 and each slot 40 for reasons to be explained.

Due to normal manufacturing tolerances, a gap remains between the edge 42 of the aperture 32 and an outer surface of the socket which could permit an undesired air leakage that, in many jurisdictions is required to be restricted. As observed earlier herein, it has been the practice to provide a transparent plate across the bottom of the trim, or mount the trim within a sealed housing or apply calk around the socket to avoid the problem.

Figure 2:
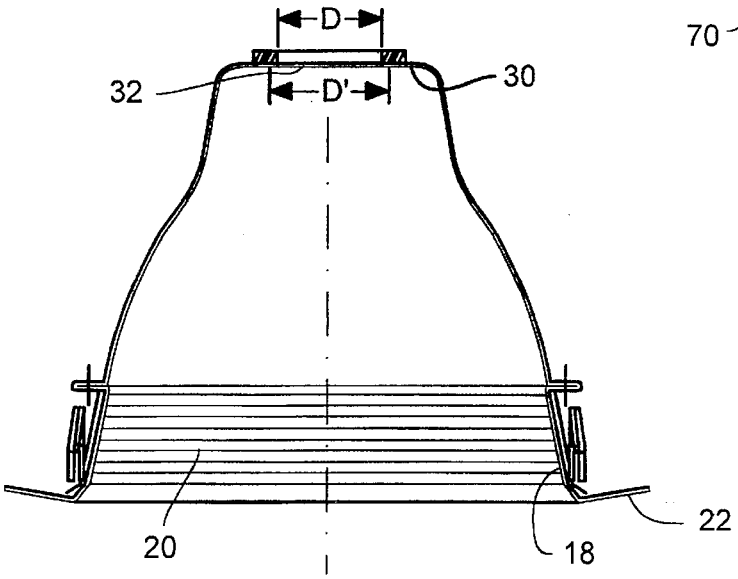
FIG. 2 is a vertical sectional view taken through the trim depicted in FIG. 1.

In accordance with the present invention, however, a much less costly solution is envisaged, namely, the provision of a gasket 50 that becomes compressed between the socket and the wall 30 to create an air seal therebetween. The gasket includes an outer peripheral edge 52 and a circular center hole 54. The diameter D of that center hole 54 is preferably slightly smaller than the diameter D' of the aperture 32 formed in the wall 30, as is apparent from FIG. 2. Thus, prior to installation of the socket 34, a center portion 58 of the gasket extends radially inwardly of the edge 42 of the aperture 32, as shown in FIG. 3.

Furthermore, the outer periphery 52, which is preferably rectangular, is dimensioned so that outer portions 56 of the slots 40 remain uncovered (see FIG. 3).

The gasket is formed of a suitably pliant high-temperature resistant material such as epichlorohydrin or silicone foam, for example.

Figure 5:
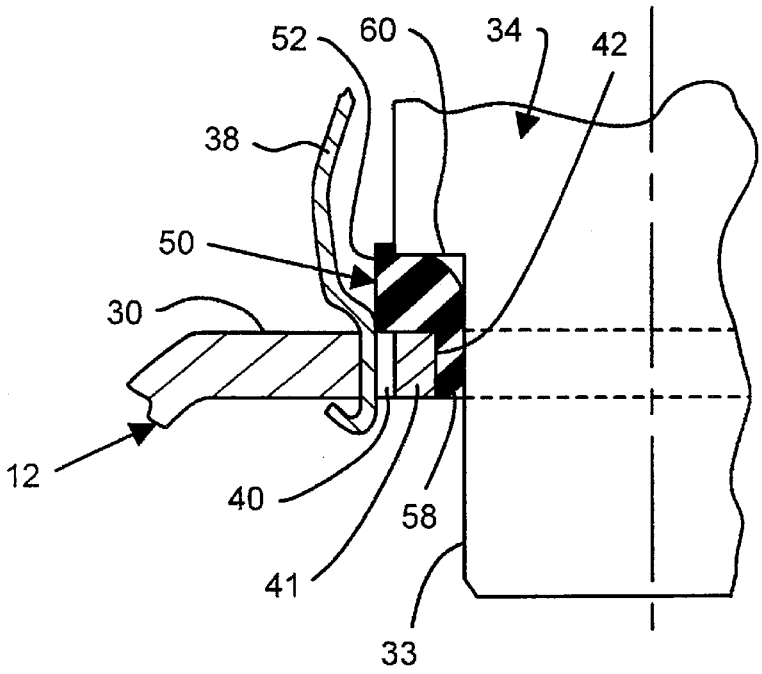
FIG. 5 is a fragmentary vertical sectional view taken along line 5—5 in FIG. 4 after the socket has been mounted to the trim.
Figure 6:
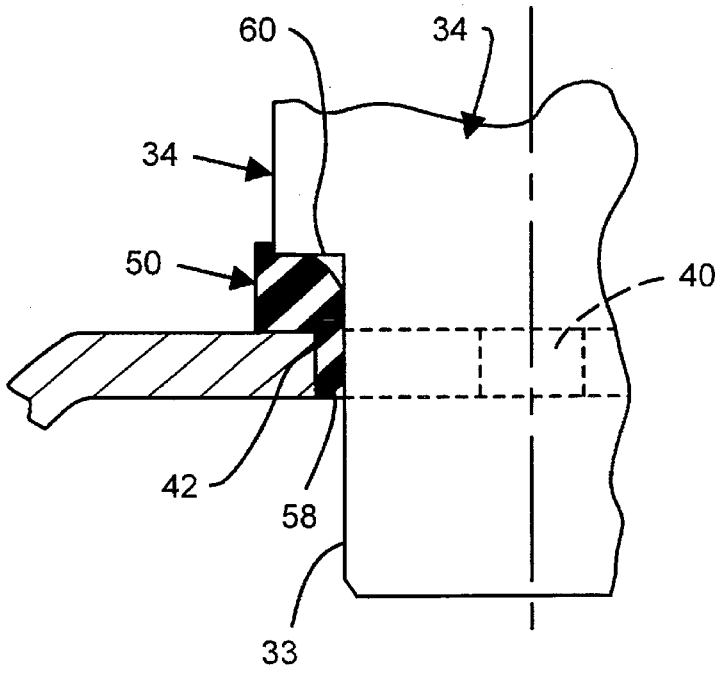
FIG. 6 is a view similar to FIG. 5 but taken along the line 6—in FIG. 4.

The socket is installed after the gasket 50 has been glued to the top wall 32. The socket is installed by inserting the spring legs into the slots 40, and by inserting the lower cylindrical portion 33 of the socket through the center aperture 32. The diameter D" of that socket portion 33 is larger than the diameter D of the circular portion 41 of the gasket hole 54, so that the socket portion 33 pushes down the inner periphery 58 of the gasket 50, causing that periphery to become compressed between the socket portion 33 and the edge 42 of the aperture 32 to perform a sealing function, as shown in FIGS. 5 and 6. Even if the diameters D and D" were equal, whereby no portion of the gasket were compressed between the socket portion 33 and the edge 42, an air seal could still be created between a shoulder 60 of the socket and the top of the gasket.

Figure 7:
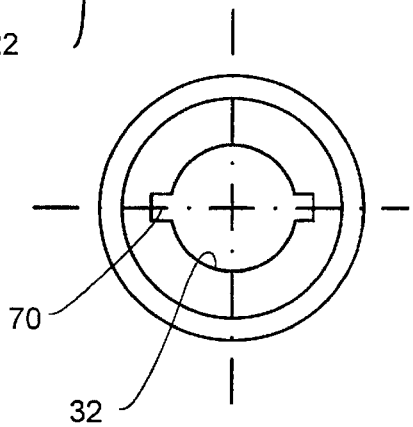
FIG. 7 (PRIOR ART)
FIG. 7 is a prior art attachment means.

Importantly, because the spring legs 38 of the socket enter slots 40 that are spaced from the aperture 32, rather than entering prior art-type slots 70 that extend all the way to the aperture (as shown in FIG. 7), it is ensured that the spring legs will be situated radially outwardly of the outer edge of the gasket. If, instead, the prior art slots 70 were used, it might be possible for the spring legs to enter the slots at a location inwardly of the outer periphery of the gasket, whereupon those legs could push the pliant gasket outwardly away from the socket and create air gaps.

It will be appreciated that the present invention provides a convenient, economical way of creating an air seal for a trim. Advantageously, the gasket can be retrofit onto existing trims to effect the seal.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A trim for a recessed lighting fixture, comprising:

a trim body having a laterally outwardly extending trim ring at a lower open end of the trim body, and a top wall at an upper end of the trim body, the top wall including a circular aperture, and a pair of slots;

a lamp socket mounted in the aperture, the lamp socket including a lower cylindrical portion projecting through the aperture, and spring legs projecting through respective ones of the slots for releasably locking the socket to the top wall; and a gasket formed of a pliable material interposed between the socket and top wall for producing an air seal therebetween.

2. The trim according to claim 1, wherein the gasket includes an inner periphery extending radially inwardly of an edge of the aperture and compressed within the aperture between the edge of the aperture and the lower cylindrical portion of the socket.

3. The trim according to claim 2, wherein the slots are spaced radially outwardly of the aperture.

4. The trim according to claim 1, wherein the slots are spaced radially outwardly of the aperture.

5. The trim according to claim 1 wherein the gasket is formed of epichlorohydrin.

6. The trim according to claim 1 wherein the outer periphery of the gasket is rectangular.

7. The trim according to claim 1 wherein the trim body includes an upper reflector portion and a lower baffle portion, the baffle portion including a laterally outward trim ring at a lower end of the trim.

8. The trim according to claim 1, wherein the gasket includes an outer peripheral portion configured to leave uncovered at least an outer portion of each slot to enable such outer portion to receive a respective spring leg.

* * * * *